US005744053A

United States Patent [19]

Kaimai

[11] Patent Number: 5,744,053

[45] Date of Patent: Apr. 28, 1998

[54] LUBRICATING OIL ADDITIVE, LUBRICATION OIL AND WORKING FLUID FOR REFRIGERATORS

[75] Inventor: Takashi Kaimai, Toda, Japan

[73] Assignee: Japan Energy Corporation, Tokyo, Japan

[21] Appl. No.: 870,788

[22] Filed: Jun. 6, 1997

Related U.S. Application Data

[63] Continuation of Ser. No. 580,982, Jan. 3, 1996, abandoned.

[30] Foreign Application Priority Data

Apr. 7, 1995 [JP] Japan ..... 7-107070
Oct. 4, 1995 [JP] Japan ..... 7-257629

[51] Int. Cl.[6] ..... C09K 5/04; C10M 129/08

[52] U.S. Cl. ..... 252/68; 508/433; 508/440; 508/485; 508/579; 508/583

[58] Field of Search ..... 252/68; 508/433, 508/440, 485, 579, 583

[56] References Cited

U.S. PATENT DOCUMENTS 2,448,664 9/1948 FiFe et al. ..... 508/579
3,933,658 1/1976 Beiswanger et al. ..... 252/31
5,036,108 7/1991 Asahi et al. ..... 514/937

FOREIGN PATENT DOCUMENTS 461262 12/1991 European Pat. Off. .
3-199296 8/1991 Japan .
4-337391 11/1992 Japan .
7-173486 7/1995 Japan .
91/09097 6/1991 WIPO .

*Primary Examiner*—Alan Diamond
*Attorney, Agent, or Firm*—Flynn, Thiel, Boutell & Tanis, P.C.

[57] ABSTRACT

A lubricating oil additive contains a partially etherified polyhydric alcohol which has at least two hydroxyl groups and at least one hydrocarbon group having a least one double bond bonded thereto through an ether linkage as an active component. The lubricating additive is added to a lube base oil to form a lubricating oil which imparts excellent wear resistance, scarcely corrodes metallic substances, scarcely swells rubbers or resins and scarcely forms sludge due to thermal oxidation. The lubricating oil is mixed with a refrigerant to give a working fluid suitable for refrigerant compressors of domestic refrigerators, automotive room air conditioners, refrigerators for industrial use and air conditioners.

26 Claims, No Drawings

LUBRICATING OIL ADDITIVE, LUBRICATION OIL AND WORKING FLUID FOR REFRIGERATORS

This application is a continuation of U.S. Ser. No. 08/580,982, filed Jan. 3, 1996 now abandoned.

BACKGROUND OF THE INVENTION

1. Field of the Invention

The present invention relates to a lubricating oil imparting excellent wear resistance, an additive used for the lubricating oil, and a working fluid for refrigerators using the lubricating oil. In particular, the present invention relates to a lubricating oil suitable for refrigerant compressors using hydrofluorocarbon refrigerants, and a working fluid for refrigerators which comprises the lubricating oil and a hydrofluorocarbon refrigerant.

Refrigerant compressors are used in domestic refrigerators, automotive air conditioners, refrigerators for industrial use and room air conditioners and refrigerants used for these refrigerant compressors include chlorofluorocarbons (hydrocarbons wherein all of the hydrogen atoms have been replaced by chlorine and fluorine atoms) and hydrochlorofluorocarbons (hydrocarbons wherein some of the hydrogen atoms have been replaced by chlorine and fluorine atoms). From the standpoint of environmental protection, however, it has been decided to restrict the use of these refrigerants, and therefore attention is now paid to hydrofluorocarbons (hydrocarbons which are non-chlorinated, i.e., do not contain any chlorine atom, and in which at least some of the hydrogen atoms are replaced by fluorine atoms, hereinafter referred to as "HFC refrigerants") as substitutes for the above refrigerants. HFC refrigerants which have already been proposed include R134a, R125, R32, R143a and R152a (which are each composed of a single hydrofluorocarbon) and R407C, R410A and R410B (a mixture of hydrofluorocarbons).

2. Description of the Prior Art

When an HFC refrigerant is used, it is difficult to use a conventional mineral lube base oil with it. Therefore, it has been proposed to use a polyoxyalkylene glycol, polyhydric alcohol ester, polyether or polycarbonate as a lube base oil.

The use of an HFC refrigerant results in a relatively poor lubrication. Further, copper and aluminum materials, as well as iron materials, are used as a material constituting the frictional surfaces of a refrigerant compressor, so that the lubricating oil used in the compressor is required to improve the wear resistance of frictional surfaces made of ferrous or non-ferrous materials satisfactorily. Known additives used for satisfying such a requirement include alkanediols having from 8 to 14 carbon atoms (Japanese Patent Laid-Open No. 199296/1991), phosphoric esters, phosphorous esters and partial esters of polyhydric alcohols with fatty acids (WO 91/09097), alcohol derivatives having two hydroxyl groups and having a $C_1$ to $C_{18}$ alkyl, aryl, alkylaryl or aralkyl group which has another polar group (Japanese Patent Laid-Open No. 337391/1992) and so forth. These additives have problems in that the wear resistance of frictional surfaces cannot be improved sufficiently, corrosion of the metal occurs in the compressor, they tend to harden rubbers and resins to cause leaks in the seal or joint of the compressor, and that sludge is formed due to thermal degradation or oxidation to lower the heat exchange efficiency, though they exhibit some effect. Thus, the above additives have not been evaluated as being sufficiently fit for practical use.

SUMMARY OF THE INVENTION

The present invention aims at solving the above problems and an object thereof is to provide a lubricating oil which can impart excellent wear resistance, which does not corrode metallic substances, which does not harden sealants made of, for example, rubbers or resins, and which form very little sludge due to thermal degradation or oxidation; an additive used for the lubricating oil; and a working fluid for refrigerators using the lubricating oil.

The inventors of the present invention have intensively studied for the purpose of solving the above problems to find that the lubricating properties (such as antiwearing effect) of a lubricating oil can be remarkably improved by adding a specific partially etherified polyhydric alcohol thereto. The present invention has been accomplished on the basis of this finding.

Namely, the present invention relates to (1) a lubricating oil additive comprising a partially etherified polyhydric alcohol which has at least two hydroxyl groups and bears at least one aliphatic hydrocarbon group having at least one double bond and bonded through an ether linkage, as an active component; (2) a lubricating oil comprising an effective amount of a partially etherified polyhydric alcohol which has at least two hydroxyl groups and bears at least one aliphatic hydrocarbon group having at least one double bond and bonded through an ether linkage and a lube base oil; and (3) a working fluid for refrigerators, which comprises a refrigerant and a lubricating oil as set forth in the item (2).

DETAILED DESCRIPTION OF THE PREFERRED EMBODIMENTS

The lubricating oil additive of the present invention is composed of a partially etherified polyhydric alcohol which has at least two hydroxyl groups and bears at least one aliphatic hydrocarbon group having at least one double bond and bonded through an ether linkage. The additive according to the present invention must satisfy the requirements that it should have at least two hydroxyl groups and that the hydrocarbon group forming the ether linkage should have at least one double bond. In such a case, the additive has an excellent solubility in a lube base oil and can impart such excellent lubricating properties as to improve the wear resistance of frictional surfaces remarkably. Further, such an additive has the characteristic of barely swelling the rubber or resin constituting the seal in contact with a lubricating oil.

These characteristics of the partially etherified polyhydric alcohol bearing an aliphatic hydrocarbon group having at least one double bond are surprising beyond expectation, in other words, peculiar.

This is because a partially etherified polyhydric alcohol not bearing an aliphatic hydrocarbon group having at least one double bond but an alkyl group having a corresponding number of carbon atoms or an aryl group bonded through an ether linkage is so poor in the solubility in a lube base oil that it fails to impart excellent lubricating properties. Further, a partially etherified polyhydric alcohol bearing a relatively short alkyl group cannot also impart excellent lubricating properties, though it has excellent solubility in a lube base oil.

It is preferable from the standpoints of solubility in a lube base oil and the prevention of rubbers or resins from swelling that the aliphatic hydrocarbon group having at least one double bond which constitutes the lubricating oil additive according to the present invention, is one having 12 to 24 carbon atoms, still preferably 16 to 20 carbon atoms. Further, it is preferable in chemical stability that the aliphatic hydrocarbon group have one carbon-carbon double bond, though it may have two or more double bonds. Furthermore, a partial ether as described above wherein the double bond is present in the inside of the hydrocarbon chain is easily available favorably. Additionally, the aliphatic hydrocarbon group having at least one double bond is preferably linear because the lubricating properties are better than those wherein the group is branched. The partially etherified polyhydric alcohol according to the present invention may bear two or more aliphatic hydrocarbon groups having at least one double bond and bonded through ether linkages respectively. The aliphatic hydrocarbon group having at least one double bond may contain oxygen atom(s) or hydroxyl group(s). Examples of the aliphatic hydrocarbon group having at least one double bond include $CH_3(CH_2)_6CH{=}CH(CH_2)_2CH_2$-(4-dodecenyl), $CH_3(CH_2)_8CH{=}CH(CH_2)_2CH_2$-(4-tetradecenyl), $CH_3(CH_2)_8CH{=}CH(CH_2)_3CH_2$-[physeteryl(5-pentadecenyl)], $CH_3(CH_2)_5CH{=}CH(CH_2)_7CH_2$-[palmitoleyl(9-hexadecenyl)], $CH_3(CH_2)_7CH{=}CH(CH_2)_7CH_2$-[oleyl(9-octadecenyl)], $CH_3(CH_2)_5CH{=}CH(CH_2)_9CH_2$-[vaccenyl(11-octadecenyl)], $CH_3(CH_2)_9CH{=}CH(CH_2)_7CH_2$-[gadoleyl(9-icosenyl)], $CH_3(CH_2)_7CH{=}CH(CH_2)_9CH_2$-(11-icosenyl), $CH_3(CH_2)_9CH{=}CH(CH_2)_9CH_2$-(11-docosenyl), $CH_3(CH_2)_7CH{=}CH(CH_2)_{11}CH_2$-(13-docosenyl), $CH_3(CH_2)_7CH{=}CH(CH_2)_{13}CH_2$-(15-tetracosenyl), $CH_3(CH_2)_3(CH_2CH{=}CH)_2(CH_2)_7CH_2$-[linoleyl(9,12-octadecadienyl)], $CH_3(CH_2CH{=}CH)_3(CH_2)_7CH_2$-[linolenyl(9,12,15-octadecatrienyl)], $CH_3(CH_2)_3(CH_2CH{=}CH)_3(CH_2)_4CH_2$-[6,9,12-linolenyl (6,9,12-octadecatrienyl)], $CH_3(CH_2)_3(CH{=}CH)_3(CH_2)_7CH_2$-[eleostearyl(9,11,13-octadecatrienyl)], $CH_3(CH_2)_6(CH_2CH{=}CH)_2(CH_2)_6CH_2$-(8,11-icosadienyl) and $CH_3(CH_2)_6(CH_2CH{=}CH)_3(CH_2)_3CH_2$-(5,8,11-icosatrienyl).

The polyhydric alcohol constituting the partially etherified polyhydric alcohol according to the present invention is one having 3 to 10 carbon atoms, preferably 3 to 6 carbon atoms, and preferable examples thereof include glycerol, pentaerythritol, dipentaerythritol, 1,4-sorbitan and 1,5-sorbitan.

The lubricating oil additive according to the present invention is composed of a partially etherified polyhydric alcohol wherein an aliphatic hydrocarbon group having at least one double bond is bonded to a hydroxyl group through an ether linkage, and preferable examples of such an additive will now be described.

Such examples include glycerol derivatives represented by the formula (1), trimethylolpropane derivatives represented by the formula (2), 1,4-sorbitan derivatives represented by the formulae (3) and (4), and 1,5-sorbitan derivatives represented by the formulae (5) and (6). The partially etherified polyhydric alcohol according to the present invention may have three or more hydroxyl groups as represented by the formula (3).

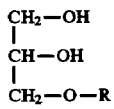

(1)

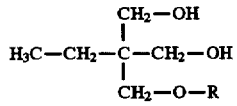

(2)

1,4-sorbitan derivative (a) (3)

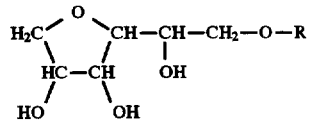

-continued 1,4-sorbitan derivative (b) (4)

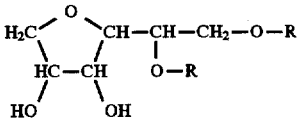

1,5-sorbitan derivative (a) (5)

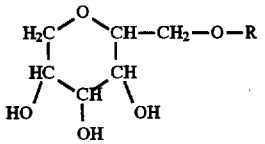

1,5-sorbitan derivative (b) (6)

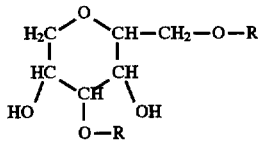

[in the formulae (1) to (6), R represents an alkenyl group having 12 to 24 carbon atoms]

Among these compounds, glycerol derivatives and 1,4-sorbitan derivatives are preferable, the glycerol derivatives being more preferable. It is preferable for the polyhydric alcohol derivative of the present invention to satisfy one or both of the requirements that the ether linkage be bonded to the carbon atom adjacent to the carbon atom to which a hydroxyl group is bonded and that at least two hydroxyl groups be bonded to two of three successive carbon atoms respectively.

Specific examples of such a partially etherified polyhydric alcohol include glycerol monooleyl ether, 1,4-sorbitan monooleyl ether, 1,4-sorbitan monolinolenyl ether and 1,5-sorbitan monooleyl ether. These ethers may have other functional groups.

The above partially etherified polyhydric alcohol can be prepared by (i) a process of reacting a corresponding partial chloride of a polyhydric alcohol (such as glycerol α-monochlorohydrin or glycerol β-monochlorohydrin) with R—OH or R—ONa, (ii) a process of reacting a trihydric or higher alcohol with R—Cl, (iii) a process of reacting epichlorohydrin with R—OH to form a glycerol monoether or the like.

The partially etherified polyhydric alcohol must be used in an amount sufficient to prevent the wear of the surfaces to be lubricated. Specifically, the amount is 0.01 to 10% by weight, preferably 0.1 to 5% by weight, still preferably 0.2 to 2% by weight based on the lubricating oil. Generally, the partially etherified polyhydric alcohol is used in an amount which is soluble in a lube base oil and one which is easily soluble in a lube base oil is selected.

The lube base oil used in the present invention includes mineral oils prepared in petroleum refining, alkylbenzenes, carbonate esters and so forth. When the lube base oil is used for a refrigerant compressor, however, it is preferable from the standpoint of solubility in HFC that the lube base oil be mainly composed of a polyether or a polyhydric alcohol ester. Polyethers are compounds having plural ether linkages in one molecule and include compounds (e.g., polyoxyalkylene glycols) having plural ether linkages in their principal chains, compounds (e.g., polyvinyl ethers) having plural ether linkages in their side-chains, cyclic ethers (e.g., crown ethers) having ether linkages for ring formation. The ratio of carbon atoms/oxygen atoms in the polyethers used in the present invention are preferably in the range of 2 to 8 and more preferably in the range of 2 to 4.

In order to improve the wear resistance of frictional surfaces effectively, it is preferable that the polyoxyalkylene glycol compound be selected from among mono- and di-alkyl ethers of polyoxypropylene glycol as represented by the following formula (7) and mono- and di-alkyl ethers of polyoxypropyleneoxyethylene glycol as represented by the following formula (8) (which are generically called "PAG derivatives" hereinafter):

$$R^1—O—(PO)_m—R^2 \quad (7)$$

$$R^1—O—(PO)_m(EO)_n—R^2 \quad (8)$$

wherein $R^1$ represents an alkyl group having 1 to 4 carbon atoms; $R^2$ represents an alkyl group having 1 to 4 carbon atoms or a hydrogen atom, with $R^1$ and $R^2$ being the same as or different from each other; m and n each represent an average degree of polymerization; and $(PO)_m(EO)_n$ represents a random or block copolymer group. When a PAG derivative is used in a state mixed with an HFC refrigerant, the derivative is preferably one having such an average degree of polymerization as to exhibit a viscosity of 5 to 20 cSt at 100° C. and the m/n ratio preferably ranges from 9:1 to 7:3. The terminal hydroxyl group of the PAG derivative may be esterified. A mixture of two or more of the above PAG derivatives may be used.

On the other hand, a polyhydric alcohol ester prepared from a polyhydric alcohol having 2 to 6 hydroxyl groups and a fatty acid can be also favorably used as the lube base oil according to the present invention. In particular, it is preferable that the polyhydric alcohol ester be a neutral one prepared by reacting a polyhydric alcohol of a neo-type skeleton having five carbon atoms with a monobasic saturated fatty acid and/or a dibasic saturated fatty acid. The polyhydric alcohol includes neopentyl glycol, trimethylol propane, pentaerythritol and dipentaerythritol. The monobasic saturated fatty acid may be a branched non-neo type having 5 to 9 carbon atoms or a mixture thereof with a linear monobasic saturated fatty acid having 5 to 8 carbon atoms. It is preferable that the above branched monobasic saturated fatty acid have a methyl or ethyl group at the α- or β-position carbon atom. It is to be noted that a polyhydric alcohol ester prepared with a fatty acid having 1 to 4 carbon atoms is problematic in lubricating properties, resistance to hydrolysis and anticorrosiveness for metals.

Specific examples of the branched monobasic saturated fatty acid include 2-methylpentanoic acid, 2-ethylpentanoic acid, 2-methylhexanoic acid, 2-ethylhexanoic acid, 2-methylheptanoic acid, 2-ethylheptanoic acid and 3,5,5-trimethylhexanoic acid, while those of the linear monobasic saturated fatty acids include n-pentanoic acid, n-hexanoic acid, n-heptanoic acid and n-octanoic acid. A dibasic fatty acid, such as succinic acid, glutaric acid, adipic acid, pimelic acid or the like, may be used together with the above monobasic saturated fatty acid to prepare a lube base oil made of a complex ester having a relatively high viscosity. Among the polyhydric alcohol esters described above, a mixture comprising a neopentyl glycol ester and a pentaerythritol ester is particularly preferable in virtue of its high solubility in an HFC refrigerant, though a composition having excellent heat stability, resistance to hydrolysis and anticorrosiveness for metals may be suitably selected from among the above polyhydric alcohol esters. It is preferable that the acid value of the ester be 0.1 mgKOH/g or below, still preferably 0.02 mgKOH/g or below.

The lubricating oil according to the present invention may further contain various additives and examples thereof include other abrasion prevention agents, antioxidants, stabilizers, antifoaming agents and metal deactivator. In particular, the addition of a phosphate is preferable, because it can further improve the wear resistance of iron-iron materials. As such phosphates, there may be mentioned aryl phosphates and alkyl phosphates including, preferably phosphates having 18 to 70 carbon atoms, more preferably, phosphates having 18 to 50 carbon atoms. Among them, aryl phosphates, especially triaryl phosphates, may be preferably added. It is still preferable to add, as the triaryl phosphate, both triphenyl phosphate and tri(alkylphenyl)phosphate. These triaryl phosphates are added in a total amount of 0.1 to 5.0% by weight, preferably 0.3 to 4.0% by weight. When the total amount is less than 0.1% by weight, the anti-wear effect of oil on the frictional surfaces will not be improved satisfactorily, while when it exceeds 5.0% by weight, not only will the wear resistance not be additionally improved but also sludge will unfavorably form in an increased amount by the degradation of phosphate.

Specific examples of the tri(alkylphenyl)phosphate include tricresyl phosphate, tris(3,5-dimethylphenyl) phosphate, tris(2,4-dimethylphenyl)phosphate, tris(mono-n-butylphenyl)phosphate, tris(mono-t-butylphenyl) phosphate and tris(isopropylphenyl)phosphate. Among these phosphates, tricresyl phosphate is fitted for practical use and tris(p-t-butylphenyl)phosphate is best in its resistance to hydrolysis. The above phosphates may be used alone or as a mixture of two or more of them.

The lubricating oil according to the present invention may further contain other conventional additives, and examples of these additives include metal deactivators such as benzotriazole derivatives and alkenyl succinate esters; antioxidants such as DBPC (2,6-di-t-butyl-p-cresol) and p,p'-dioctyldiphenylamine; and epoxy stabilizers for HFC refrigerants such as 2-ethylhexyl glycidyl ether, sec-butyl phenyl glycidyl ether and monoglycidyl ethers having an acyl group having 5 to 10 carbon atoms.

The lubricating oil according to the present invention is mixed with a refrigerant to give a working fluid suitably usable for refrigerant compressors of domestic refrigerators, automotive air conditioners, refrigerators for industrial use and room air conditioners. The weight ratio of the lubricating oil to the refrigerant may generally range from 10:90 to 90:10, particularly preferably from 20:80 to 80:20. It is preferable that the refrigerant to be used be a hydrofluorocarbon prepared by replacing some of the hydrogen atoms of a hydrocarbon having 1 or 2 carbon atoms by fluorine atoms, for example, 1,1,1,2-tetrafluoroethane (R134a), pentafluoroethane (R125), difluoromethane (R32), 1,1,1-trifluoroethane (R143a) or 1,1-difluoroethane (R152a). Alternatively, a mixture (e.g., R407C, R410A, R410B, etc.) of two or more of these hydrofluorocarbon refrigerants can be used. The viscosity of the lubricating oil may be suitably controlled and is generally 5 to 500 cSt as determined at 40° C. Specifically, a lubricating oil exhibiting a viscosity of 8 to 32 cSt at 40° C. is suitable for domestic refrigerators, one exhibiting a viscosity of 25 to 100 cSt at 40° C. is suitable for room air conditioners and refrigerators for industrial use, and one exhibiting a viscosity of 8 to 30 cSt at 100° C. is suitable for automotive air conditioners.

The present invention will now be described specifically by referring to the following Examples, though the present invention is not limited to them.

EXAMPLES

For the Examples and Comparative Examples, test oils were prepared and evaluated.

Base oil 1 is a mixed fatty acid ester of a polyhydric alcohol, specifically, a neutral ester prepared by the reaction of a branched saturated fatty acid mixture comprising 2-ethylhexanoic acid and 3,5,5-trimethylhexanoic acid with pentaerythritol and exhibiting a viscosity of 64 cSt at 40° C.

Base oil 2 is a mixture of two polyhydric alcohol esters, specifically, a mixture comprising 80% by weight of a neutral ester prepared by the reaction of neopentyl glycol with 2-ethylhexanoic acid and 20% by weight of a neutral ester prepared by the reaction of pentaerythritol with 2-ethylhexanoic acid and exhibiting a viscosity of 10 cSt at 40° C.

Base oil 3 is a polyoxyalkylene glycol dimethyl ether having a structure represented by the following formula (9) and exhibiting a viscosity of 19 cSt at 100° C.:

$$CH_3—O—[(PO)_m(EO)_n]—(EO)_o—CH_3 \quad (9)$$

wherein $[(PO)_m(EO)_n]$ represents a random copolymer group; (n+o)/m is 0.2; and n/m is 0.1.

Glycerol monooleyl ether (hereinafter abbreviated to "GMOE") and 1,4-sorbitan monooleyl ether (hereinafter abbreviated to "SMOE") were used as the partially etherified polyhydric alcohol additives. The glycerol monooleyl ether used was identified by elemental analysis and based on the absorption at 3425 $cm^{-1}$, 2926 $cm^{-1}$, 1465 $cm^{-1}$ and 1124 $cm^{-1}$ as found in the infrared spectroscopic analysis. The 1,4-sorbitan monooleyl ether used was also identified in a similar manner to that described above.

Further, tricresyl phosphate (hereinafter abbreviated to "TCP") and triphenyl phosphate (hereinafter abbreviated at "TPP") were used as phosphate additives, while glycerol monooleate (hereinafter abbreviated to "GMO") and sorbitan monooleate (hereinafter abbreviated to "SMO") were used as comparative additives.

The compositions of test oils prepared by the use of the base oils 1, 2 and 3 are given in Tables 1 to 3 as Examples 1 to 12 and Comparative Examples 1 to 9. Each test oil contains 0.1% by weight of DBPC as an antioxidant.

The test oils were each mixed with an HFC refrigerant to form working fluids. These working fluids were subjected to a (1) wear test, (2) stability test and (3) actual-machine wear test. The wear test (1) was conducted by the use of a Falex friction machine under the following conditions and the wear thus determined is given in Tables 1 to 3.

block material: AISI-1137 pin material: SAE-3135 load: 300 lb number of revolutions: 290 rpm oil temp.: 60° C.

refrigerant: injection of R134a (70 ml/min)

TABLE 1

| base oil 1: | polyhydric alcohol ester of mixed fatty acid | | | | | | |
|---|---|---|---|---|---|---|---|
| viscosity: | 64 cSt (40° C.) | | | | | | |
| Additive | Example | | | | Comparative Example | | |
| (wt %) | 1 | 2 | 3 | 4 | 1 | 2 | 3 |
| GMOE | 0.2 | 2.0 | — | — | — | — | — |
| SMOE | — | — | 0.2 | 2.0 | — | — | — |
| GMO | — | — | — | — | — | 2.0 | — |
| SMO | — | — | — | — | — | — | 2.0 |
| wear [mg] | 2.9 | 1.2 | 3.9 | 1.4 | 8.3 | 5.6 | 6.1 |

TABLE 2

| base oil 2: | mixture of polyhydric alcohol esters | | | | | | |
|---|---|---|---|---|---|---|---|
| viscosity: | 10 cSt (40° C.) | | | | | | |
| Additive | Example | | | | Comparative Example | | |
| (wt %) | 5 | 6 | 7 | 8 | 4 | 5 | 6 |
| GMOE | 0.2 | 2.0 | 0.5 | 0.5 | — | — | — |

TABLE 2-continued

| base oil 2: | mixture of polyhydric alcohol esters | | | | | | |
|---|---|---|---|---|---|---|---|
| viscosity: | 10 cSt (40° C.) | | | | | | |
| Additive | Example | | | | Comparative Example | | |
| (wt %) | 5 | 6 | 7 | 8 | 4 | 5 | 6 |
| TCP | — | — | 1.0 | 1.0 | — | 1.0 | 1.0 |
| TPP | — | — | — | 0.2 | — | — | 0.2 |
| GMO | — | — | — | — | — | 0.5 | — |
| SMO | — | — | — | — | — | — | 0.5 |
| wear [mg] | 3.0 | 1.8 | 1.2 | 0.8 | 14.6 | 4.5 | 5.2 |

TABLE 3

| base oil 3: | polyoxyalkylene glycol dimethyl ether | | | | | | |
|---|---|---|---|---|---|---|---|
| viscosity: | 19 cSt (100° C.) | | | | | | |
| Additive | Example | | | | Comparative Example | | |
| (wt %) | 9 | 10 | 11 | 12 | 7 | 8 | 9 |
| GMOE | 0.2 | 2.0 | 0.5 | 0.5 | — | — | — |
| TCP | — | — | 1.0 | 1.0 | — | 1.0 | 1.0 |
| TPP | — | — | — | 0.2 | — | — | — |
| GMO | — | — | — | — | — | 0.5 | — |
| SMO | — | — | — | — | — | — | 0.5 |
| wear [mg] | 2.8 | 1.5 | 1.1 | 0.6 | 13.5 | 4.4 | 5.2 |

The stability test (2) was conducted by the sealed tube method. A mixture comprising each test oil and an HFC refrigerant (R134a) at a volume ratio of 7:3 was put in a glass tube together with iron copper or aluminum catalyst based upon JIS K2211. The resulting glass tube was sealed and kept at 175° C. for 336 hours to determine whether the appearance changed or not. In all of the Examples and Comparative Examples, there was found neither a change in the appearance nor the formation of sludge.

The actual-machine wear test (3) was conducted by charging a working fluid comprising 400 ml of each test oil and 590 g of an HFC refrigerant (R407c) into a compressor (rotary type refrigerant compressor) of a domestic refrigerator. The compressor was run for an endurance test under the following conditions and thereafter disassembled to determine the wear of the roller and the vane. Further, the resulting lubricating oil was analyzed for metal content. The results are given in Table 4. The HFC refrigerant R407C is a mixture comprising R32, R125 and R134a at a weight ratio of 23:25:52.

discharge side pressure: 27 $kg/cm^2$ G intake side pressure: 5 $kg/cm^2$ G discharged gas temp: 110° C.

running time: 600 hours (continuous running)

frequency: 60 Hz

TABLE 4

| | Wear (μm) | | Metal content in lubricating oil |
|---|---|---|---|
| | roller | vane | (iron ppm) |
| Ex. 1 | 1.33 | 1.56 | <1 |
| Ex. 2 | 0.31 | 0.25 | <1 |
| Ex. 3 | 1.35 | 1.58 | <1 |
| Ex. 4 | 0.38 | 0.28 | <1 |
| Comp. Ex. 1 | 4.77 | 4.29 | 5 |
| Comp. Ex. 2 | 2.74 | 2.71 | 3 |
| Comp. Ex. 3 | 3.05 | 3.00 | 4 |

TABLE 4-continued

| | Wear (μm) | | Metal content in lubricating oil |
|---|---|---|---|
| | roller | vane | (iron ppm) |
| Ex. 9 | 1.55 | 1.65 | <1 |
| Ex. 10 | 0.40 | 0.31 | <1 |
| Ex. 11 | 0.59 | 0.53 | <1 |
| Ex. 12 | 0.48 | 0.29 | <1 |
| Comp. Ex. 7 | 6.89 | 5.80 | 7 |
| Comp. Ex. 8 | 2.70 | 2.65 | 3 |
| Comp. Ex. 9 | 2.90 | 2.88 | 3 |

As described above, the partially etherified polyhydric alcohol of the lubricating oil additive according to the present invention bears an aliphatic hydrocarbon group bonded through an ether linkage and it is essential that the aliphatic hydrocarbon group have at least one double bond. When the aliphatic hydrocarbon group is saturated, its solubility in a lube base oil will be poor. In order to demonstrate this, the following test was conducted.

0.2 or 0.4% by weight of each of the following glycerol ethers was added to the above base oil 1 to prepare a lubricating oil. Each lubricating oil was mixed with a refrigerant (R134a) at a volume ratio of 1:9. The floc points of the working fluids thus prepared were determined according to JIS K2211. The results are as follows (unit: °C.):

| Additive | 0.2 wt % | 0.4 wt % |
|---|---|---|
| glycerol monooleyl ether ($C_{18}$ alkenyl) | −15 | −10 |
| glycerol monostearyl ether ($C_{18}$ alkyl) | 23 | 31 |
| glycerol monocetyl ether ($C_{16}$ alkyl) | 18 | 25 |

Floc point refers to a temperature at which an additive precipitates. It can be understood from the above results that the addition of a glycerol alkyl ether in such an amount as to lower the wear sufficiently is difficult owing to the poor solubility thereof.

The lubricating oil and working fluid for refrigerators according to the present invention contain a partially etherified polyhydric alcohol which has at least two hydroxyl groups and bears at least one hydrocarbon group having at least one double bond and bonded through an ether linkage, so that they can impart excellent wear resistance and hardly cause the corrosion of metal or the formation of sludge. The lubricating oil is particularly suitable for refrigerant compressors using hydrofluorocarbon refrigerants.

What is claimed is:

1. A lubricating oil additive comprising a phosphate and a partially etherified polyhydric alcohol, said partially etherified polyhydric alcohol comprising a polyhydric alcohol moiety having at least two hydroxyl groups and at least one alkenyl group having one to three double bonds and 12 to 24 carbon atoms, said alkenyl group being attached to said polyhydric alcohol moiety through an ether linkage provided at a hydroxyl group position of said polyhydric alcohol moiety other than the positions of the at least two hydroxyl groups, said phosphate comprising a trialkyl phosphate, a triaryl phosphate or a mixture thereof, with the privoso that at least one of the following conditions are satisfied, the polyhydric alcohol moiety has from three to six carbon atoms, the ether linkage is at a carbon atom which is adjacent to a carbon atom having one of at least two hydroxyl groups attached thereto or at least two carbon atoms of three successively adjoining carbon atoms in said polyhydric alcohol moiety have a hydroxyl group attached thereto.

2. A lubricating oil additive as set forth in claim 1, wherein said alkenyl group has 16 to 20 carbon atoms.

3. A lubricating oil additive as set forth in claim 2, wherein the polyhydric alcohol moiety has from 3 to 6 carbon atoms.

4. A lubricating oil additive as set forth in claim 3, wherein the polyhydric alcohol moiety is derived from glycerol.

5. A lubricating oil additive as set forth in claim 1, wherein said ether linkage is at a carbon atom which is adjacent to a carbon atom having one of said at least two hydroxyl groups attached thereto.

6. A lubricating oil additive as set forth in claim 1, wherein at least two carbon atoms of three successively adjoining carbon atoms in said polyhydric alcohol moiety have a hydroxyl group attached thereto.

7. A lubricating oil having a viscosity of from 5 to 500 cSt at 40° C. and comprising a lubricating oil additive and a lube base oil, said lubricating oil additive comprising a phosphate and a partially etherified polyhydric alcohol, said partially etherified polyhydric alcohol comprising a polyhydric alcohol moiety having at least two hydroxyl groups and at least one alkenyl group having one to three double bonds and 12 to 24 carbon atoms, said alkenyl group being attached to said polyhydric alcohol moiety through an ether linkage provided at a hydroxyl group position of said polyhydric alcohol moiety other than the positions of the at least two hydroxyl groups, said phosphate comprising a trialkyl phosphate, a triaryl phosphate or a mixture thereof, said partially etherified polyhydric alcohol and said phosphate being contained in amounts of 0.01 to 2.0% by weight and 0.1 to 5.0% by weight, respectively, based on the total weight of the lubricating oil, with the privoso that at least one of the following conditions are satisfied, the polyhydric alcohol moiety has from three to six carbon atoms, the ether linkage is at a carbon atom which is adjacent to a carbon atom having one of at least two hydroxyl groups attached thereto or at least two carbon atoms of three successively adjoining carbon atoms in said polyhydric alcohol moiety have a hydroxyl group attached thereto.

8. A lubricating oil as set forth in claim 7, wherein the lube base oil comprises a polyhydric alcohol ester or a polyether.

9. A lubricating oil as set forth in claim 7, wherein said alkenyl group has 16 to 20 carbon atoms.

10. A lubricating oil as set forth in claim 9, wherein the polyhydric alcohol moiety has from 3 to 6 carbon atoms.

11. A lubricating oil as set forth in claim 10, wherein the polyhydric alcohol moiety is derived from glycerol.

12. A lubricating oil as set forth in claim 7, wherein said ether linkage is at a carbon atom which is adjacent to a carbon atom having one of at least two hydroxyl groups attached thereto.

13. A lubricating oil as set forth in claim 7, wherein at least two carbon atoms of three successively adjoining carbon atoms in said polyhydric alcohol moiety have a hydroxyl group attached thereto.

14. A lubricating oil as set forth in claim 7, wherein said lube base oil comprises a polyether having a carbon atom/oxygen atom ratio of from 2 to 8.

15. A lubricating oil as set forth in claim 14, wherein said carbon atom/oxygen atom ratio is from 2 to 4.

16. A working fluid composition for refrigeration compressors comprising a refrigerant and a lubricating oil, said lubricating oil having a viscosity of 5 to 500 cSt at 40° C. and comprising a lubricating oil additive and a lube base oil, said lubricating oil additive comprising a phosphate and a partially etherified polyhydric alcohol, said partially etherified polyhydric alcohol comprising a polyhydric alcohol moiety having at least two hydroxyl groups and at least one alkenyl group having one to three double bonds and 12 to 24 carbon atoms, said alkenyl group being attached to said polyhydric alcohol moiety through an ether linkage provided at a hydroxyl group position of said polyhydric alcohol moiety other than the positions of the at least two hydroxyl groups, said phosphate comprising a trialkyl phosphate, a triaryl phosphate or a mixture thereof, said partially etherified polyhydric alcohol and said phosphate being contained in amounts of 0.01 to 2.0% by weight and 0.1 to 5.0% by weight, respectively, based on the total weight of the lubricating oil, with the privoso that at least one of the following conditions are satisfied, the polyhydric alcohol moiety has from three to six carbon atoms, the ether linkage is at a carbon atom which is adjacent to a carbon atom having one of at least two hydroxyl groups attached thereto or at least two carbon atoms of three successively adjoining carbon atoms in said polyhydric alcohol moiety have a hydroxyl group attached thereto.

17. A working fluid composition as set forth in claim 16 wherein the refrigerant comprises a hydrofluorocarbon.

18. A working fluid composition as set forth in claim 16, wherein said ether linkage is at a carbon atom which is adjacent to a carbon atom having one of at least two hydroxyl groups attached thereto.

19. A working fluid composition as set forth in claim 16, wherein at least two carbon atoms of three successively adjoining carbon atoms in said polyhydric alcohol have a hydroxyl group attached thereto.

20. A working fluid composition as set forth in claim 16, wherein said lube base oil comprises a polyether having a carbon atom/oxygen atom ratio of from 2 to 8.

21. A working fluid composition as set forth in claim 20, wherein said carbon atom/oxygen atom ratio is from 2 to 4.

22. In a method of lubricating a refrigeration compressor utilizing a hydrofluorocarbon refrigerant, the improvement comprising lubricating said compressor with a lubricating oil having a viscosity of 5 to 500 cSt at 40° C. and comprising a lubricating oil additive and a lube base oil, said lubricating oil additive comprising a phosphate and a partially etherified polyhydric alcohol, said partially etherified polyhydric alcohol comprising a polyhydric alcohol moiety having at least two hydroxyl groups and at least one alkenyl group having one to three double bonds and 12 to 24 carbon atoms, said alkenyl group being attached to said polyhydric alcohol moiety through an ether linkage provided at a hydroxyl group position of said polyhydric alcohol moiety other than the positions of the at least two hydroxyl groups, said phosphate comprising a trialkyl phosphate, a triaryl phosphate or a mixture thereof, said partially etherified polyhydric alcohol and said phosphate being contained in amounts of 0.01 to 2.0% by weight and 0.1 to 5.0% by weight, respectively, based on the total weight of the lubricating oil, with the privoso that at least one of the following conditions are satisfied, the polyhydric alcohol moiety has from three to six carbon atoms, the ether linkage is at a carbon atom which is adjacent to a carbon atom having one of at least two hydroxyl groups attached thereto or at least two carbon atoms of three successively adjoining carbon atoms in said polyhydric alcohol moiety have a hydroxyl group attached thereto.

23. A lubricating method as set forth in claim 22, wherein said ether linkage is at a carbon atom which is adjacent to a carbon atom having one of at least two hydroxyl groups attached thereto.

24. A lubricating method as set forth in claim 22, wherein at least two carbon atoms of three successively adjoining carbon atoms in said polyhydric alcohol moiety have a hydroxyl group attached thereto.

25. A method as set forth in claim 22, wherein said lube base oil comprises a polyether having a carbon atom/oxygen atom ratio of from 2 to 8.

26. A method as set forth in claim 25, wherein said carbon atom/oxygen atom ratio is from 2 to 4.

* * * * *

UNITED STATES PATENT AND TRADEMARK OFFICE

CERTIFICATE OF CORRECTION

PATENT NO. : 5 744 053

DATED : April 28, 1998

INVENTOR(S) : Takashi KAIMAI

It is certified that error appears in the above-indentified patent and that said Letters Patent is hereby corrected as shown below:

Column 11, line 29; change "polyhydric alcohol have a"
to ---polyhydric alcohol moiety have a---.

Signed and Sealed this

Twenty-fifth Day of August, 1998

Bruce Lehman

*Attest:*

BRUCE LEHMAN

*Attesting Officer*

*Commissioner of Patents and Trademarks*